United States Patent [19]

Neuhaus

[11] Patent Number: 4,898,068

[45] Date of Patent: Feb. 6, 1990

[54] TORQUE WRENCH

[75] Inventor: Klaus Neuhaus, Wuppertal, Fed. Rep. of Germany

[73] Assignee: Eduard Wille GmbH u. Co., Fed. Rep. of Germany

[21] Appl. No.: 317,674

[22] Filed: Mar. 1, 1989

[30] Foreign Application Priority Data

Mar. 11, 1988 [DE] Fed. Rep. of Germany ..... 3808120

[51] Int. Cl.[4] ..... B25B 23/142

[52] U.S. Cl. ..... 81/483; 81/478

[58] Field of Search ..... 81/478, 483

[56] References Cited

U.S. PATENT DOCUMENTS

| | | | |
|---|---|---|---|
| 3,202,021 | 8/1965 | Livermont . | |
| 4,655,104 | 4/1987 | Blattner | 87/483 |

FOREIGN PATENT DOCUMENTS

| | | | |
|---|---|---|---|
| 209452 | 7/1957 | Australia | 81/483 |
| 679042 | 7/1939 | Fed. Rep. of Germany . | |
| 2535236 | 4/1977 | Fed. Rep. of Germany . | |
| 781044 | 11/1980 | U.S.S.R. | 81/478 |
| 732013 | 6/1955 | United Kingdom | 81/483 |
| 966947 | 8/1964 | United Kingdom . | |

*Primary Examiner*—James G. Smith

*Attorney, Agent, or Firm*—Mallinckrodt & Mallinckrodt

[57] ABSTRACT

A torque wrench comprises an elongate outer housing, an elongate inner part extending in and beyond the outer housing and pivotally connected thereto proximate an end in common of the torque wrench, the extending portion of the inner part providing a handle for the wrench at the end thereof opposite the end in common, the outer housing being adapted to hold a tool at the end in common preferably free of the inner part, and a spring-loaded toggle lever mechanism acting between the handle portion of the inner part and the outer housing and arranged to release when a predetermined torque, that is transmitted to the tool through the handle portion, the toggle lever mechanism, and the outer housing, is exceeded, thereby causing pivotal movement between the outer housing and the inner part. Mechanism is provided, preferably internally of the wrench, whereby spring tension of the toggle lever mechanism can be adjustably set manually from the exterior of the wrench, and a scale is associated with the toggle lever mechanism so that it can be read by the user of the wrench.

20 Claims, 2 Drawing Sheets

TORQUE WRENCH

BACKGROUND OF THE INVENTION

1. Technical Field

The invention relates to a torque wrench, comprising (a) an elongated outer housing, (b) an inner part extending in the outer housing and pivotably connected thereto in the proximity of a first end of the torque wrench, (c) a tool arranged at the first end, (d) a handle portion arranged at the second end of the torque wrench, and (e) a spring loaded toggle lever mechanism acting between the handle portion and the element carrying the tool, which toggle lever mechanism releases when a torque exerted on the tool through the handle portion, the toggle lever mechanism and said element is exceeded, and which permits a pivotal movement between outer housing and inner part.

2. Background Art

Such a torque wrench is known, for example, from U.S. Pat. No. 4,655,104. In this torque wrench the inner part is a solid body, which is mounted in the outer housing at its first end and which carries a tool at its end extending out of the outer housing. A link is pivoted with one of its ends at the end of the inner part on the handle side. A pin is located at the other end of the link, a spring acting longitudinally of the outer housing pressing on this pin. The inner part and the spring loaded link form a toggle lever mechanism, which releases, overcoming the bias of the spring, when a predetermined torque has been exceeded, and which permits snapping movement of the inner part relative to the outer housing, providing an audible and tactile signal.

Similar releasing torque wrenches are shown in U.S. Pat. No. 3,202,021, British patent No. 966,947 and German patent document No. 25 53 326. Therein the toggle lever mechanism consists of a spring loaded lever supported with a roller on the inner wall of the outer housing and a link connecting this lever with the inner part.

In another known torque wrench the toggle lever mechanism comprises a lever, which is pivotably mounted in the outer housing and the handle portion integral therewith. This lever presses with one end on the end of the inner part adjacent to the handle. The other end of the lever is connected through a link to a spring loaded slider longitudinally movable in the outer housing.

In the known torque wrenches the torque is transmitted through the inner part. Thus, this inner part has to be very stable. Because the inner part is arranged within the outer housing, this stability is achieved only by a solid construction of the inner part, usually as forged part. This, in turn, results in the torque wrench becoming rather heavy.

A further disadvantage of the known torque wrenches of the type described above consists in that the point of rotation of the screw, about which the user exerts the torque on the screw, is substantially different from the pivot point of the inner part relative to the outer housing, which serves as "functional point of rotation". This results in the releasing point being very much dependent on the point of attack at the handle portion.

German patent No. 679,042 discloses a wrench having limited force transmission. In this wrench, two elongated housing portions cut-off along oblique planes, namely a tool-side housing portion and a handle-side housing portion, are interconnected by a pivot axle. A bending spring, on one side thereof, is supported both on the pivot axle and on a transverse axle provided in the handle-side housing portion. On the opposite side, an adjusting screw engages the bending spring between these two axles. A desired bias of the bending spring can be set by means of the adjusting screw. A handle is attached to the end of the bending spring extending from the handle-side housing portion. Furthermore a lug is provided on the bending spring and extends over a locking pawl and retains this pawl in its operative position. The locking pawl, in its operative position, extends over a stop provided on the tool-side housing portion and keeps the housing portions in an extended mutual position. The tool-side housing portion carries a tool.

When the torque acting on the bending spring exceeds the bias set by the adjusting screw, the bending spring yields. The lug then releases the blocking pawl. The blocking pawl, in turn, releases the stop, whereby the two housing portions will be deflected.

DISCLOSURES OF INVENTION

It is the object of the invention to provide a simple and lightweight torque wrench.

It is furthermore the object of the invention to place the pivot point of the housing parts closer to the point of rotation of the screw and thus to make the releasing torque less dependent on the point of attack in which the user touches the handle portion.

It is furthermore the object of the invention, in a torque wrench of the above defined type, to increase the length of the lever arm engaged by the toggle lever mechanism, such that the effective forces and the bias of the spring can be reduced.

According to the invention these objects are achieved in that (f) the tool is attached to the outer housing, and (g) the inner part is rigidly attached to the handle portion.

Due to the fact, that the tool is supported by the outer housing, which naturally has larger dimensions than the inner part, the required stability can be achieved with a relatively small wall thickness of the outer housing. The torques acting on the inner part are smaller. Thus, the inner part can be made considerably more lightweight than in the described prior art torque wrenches. This results in a mass reduction of the entire torque wrench, when the dimensions and the torques are identical.

Due to the fact, that the tool is supported by the outer housing, the distance between the tool and the pivot point between outer housing and inner part can be reduced. Because the toggle lever mechanism engages the outer housing, as the element carrying the tool, and not the inner part, the point of attack of the toggle lever mechanism can be displaced toward the handle side. Both influences act in the sense of increasing the "functional lever arm", that is the lever arm, with which the toggle lever mechanism engages the tool carrying part.

The pivot point of the inner part can be shifted toward the point of screwing rotation.

No toggle-lever mechanism between a handle portion and an element carrying the tool, that would be the tool-side housing portion, is provided in the wrench of German patent 679,042. The inner housing portion, this would be the handle-size housing portion, is not rigidly attached to a hanlde portion. The handle is attached to the bending spring. A torque about the adjusting screw is exerted on the bending spring through the handle. This adjusting screw is located at quite a distance from the axis of rotation of the tool.

Modifications of the invention are subject matter of the sub-claims.

An embodiment of the invention will now be described in greater detail with reference to the accompanying drawings.

ILLUSTRATION OF THE PRIOR ART

Figure 1:
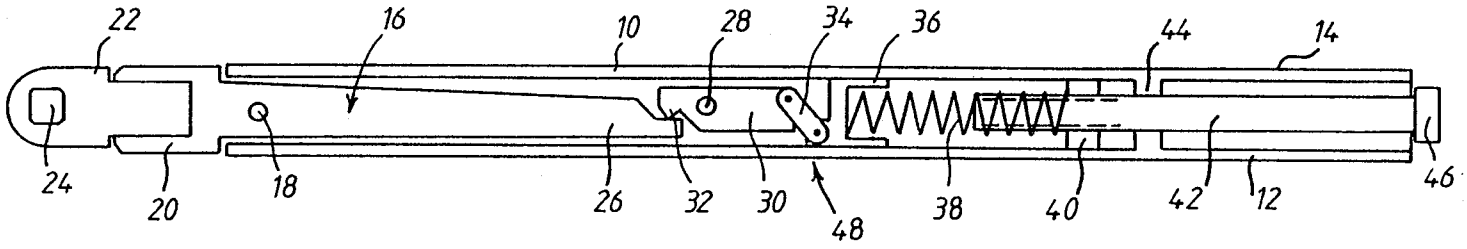
FIG. 1 shows a prior art torque wrench to illustrate the improvement achieved with the invention, with respect to the lever arm lengths and to the mutual position of the point of rotation of the screw and pivot point of the inner part.

FIG. 1 shows a prior art torque wrench.

The torque wrench has an outer housing 10, which is formed by a profile tube of rectangular cross section. At its right end in FIG. 1, the profile tube 10 forms a handle portion 12, which is engaged by the hand of the user. Numeral 14 designates the mean point of attack.

In the proximity of the left end in FIG. 1, an inner part 16 is pivotably mounted in the outer housing 10 about a bearing pin 18. The inner part 16 is formed by a solid forged part. The inner part 16 projects out of the outer housing 10 to the left in FIG. 1 and forms a tool accommodation 20 for a detachable tool 22. The detachable tool 22 acts about a point of rotation 24 of a screw. A shaft 26 of the inner part 16 projects to the right in FIG. 1.

In the center area of the outer housing 10 a two-armed lever 30 is mounted on a bearing pin 28. The two-armed lever 30 has a lug 32. The lug 32 engages the inner part 16. The second arm of the lever 30 is connected through a link 34 to a slider 36, which is movably guided in the outer housing 10. The slider 36 is exposed to the action of a spring 38 supported on a nut 40. The nut 40 is non-rotatably guided in the outer housing of rectangular cross section and is arranged on a threaded spindle 42. The threaded spindle 42 is rotatably but axially non-movably mounted in a bearing portion 44. The threaded spindle 42 can be rotated by a button 46. Thereby the nut 42 is axially displaced and the bias of the spring 38 is changed.

The spring 38, the link 34 and the lever 30 form a toggle lever mechanism 48. The spring 38 tends to pivot the lever 30 counter-clockwise through the link 34, which forms an angle with the longitudinal direction of the outer housing 10. Thereby the lever 30 holds the inner part 16 in the illustrated position. When a torque is exerted clockwise in FIG. 1 on the outer housing 10, a torque acts, due to the reaction moment of the screw, on the inner part 16 about the bearing pin 18 and tends to rotate the inner part 16 relative to the outer portion 10 counter-clockwise in FIG. 1. The torque exerted by the spring 38 through the toggle lever mechanism 48 with the lever 30 counteracts such torque. When a certain torque exerted on the screw about the point of rotation of the screw has been exceeded, the magnitude of which torque can be set at the button 46, then the reaction moment acting on the inner part 16 overcomes the spring 38 through the toggle lever arm 48. The inner part 16 is jerkily pivoted relative to the outer housing 10. The lever 30 hits the inner wall of the outer housing. This is heard and felt by the user.

It can be seen, that the bearing pin 18 of the inner part 16 is displaced by a quite large distance relative to the point of rotation 24 of the screw. The "function lever", that means the distance between bearing pin 18 and lug 32, is quite short.

BEST MODE OF CARRYING OUT THE INVENTION

Figure 2:
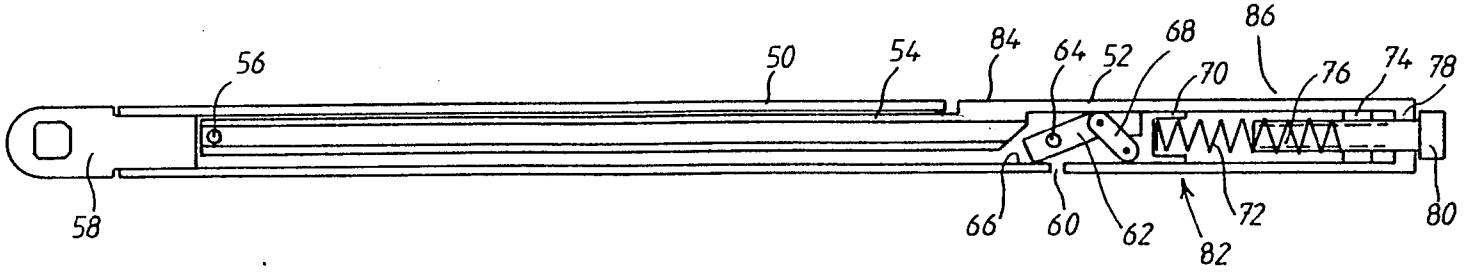
FIG. 2 is a schematic illustration similar to FIG. 1 of a torque wrench mounted according to the invention.

In the torque wrench of FIG. 2 numeral 50 designates an outer housing. The outer housing 50 is formed by a profile tube of rectangular cross section. A handle portion 52 consists likewise of a profile tube of rectangular cross section. However, the handle portion is formed as a component separate from the outer housing. An inner part 54 is likewise formed by a profile tube of rectangular cross section. This inner part 54 is fixedly connected to the handle portion 52. The outer housing 50 is pivotably mounted on the inner part 54 by means of a bearing pin 56. A tool 58 is inserted into the left end in FIG. 2 of the outer housing 50.

The right end in FIG. 2 of the outer housing 50 is cut-off obliquely. The lower wall of the outer housing 50 in FIG. 2 projects relative to the upper wall in FIG. 2. The handle portion 52 is correspondingly cut-off obliquely at its left end in FIG. 2. The upper wall in FIG. 2 projects relative to the lower wall in FIG. 2. Thereby a narrow slot 60 extending obliquely is formed between outer housing 50 and handle portion 52, which slot 60 permits a relative movement of the elements.

In the side walls of the handle portion 52 obliquely projecting from the lower wall a two-armed lever 62 is mounted on a bearing pin 64. With its left end in FIG. 2 on the side of the tool, the lever 62 engages the projecting wall 66 at the right end of the outer housing 50. The other end of the lever 62 is connected to a slider 70 through a link 68. The slider 70 is is movably guided in the handle portion 52. A biased spring 72 engages the slider. The spring 72 is supported on a nut 74. The nut 74 has rectangular cross section and is non-rotatably but movably guided in the handle portion 52. The nut 74 is guided on a threaded adjusting spindle 76. The adjusting spindle is rotatably but axially non-movably mounted in an end piece 78 of the handle portion 52. An adjusting button 80 is provided at the end of the adjusting spindle.

The arrangement with the lever 62, the link 68, the slider 70 and the spring 72 forms a toggle lever mechanism 82.

The upper portion 84 projecting to the left of the wall of the handle portion 52 in FIG. 2 is fixedly connected to the inner part 54.

In FIG. 2 numeral 86 designates the mean point of attack, at which the user engages the handle portion 52.

The described torque wrench operates as follows:

In normal operation the outer housing 50 is held by the lever 62, against the action of the torque applied through the tool 58, in its illustrated position relative to the inner part. The upper wall of the outer housing in FIG. 2 engages the upper wall of the inner part 54 in FIG. 2, when the torque wrench is rotated clockwise in FIG. 2. When a predetermined torque has been exceeded, the lever 62 of the toggle lever mechanism 82 yields and urges the slider 70 to the right in FIG. 2 through the link 68. The more the "toggle" formed by the lever 62 and the link 68 is stretched, the larger is the force component acting longitudinally of the torque wrench. Therefore, after the lever 62 has yielded, the mechanical resistance of the toggle lever mechanism breaks down. The handle portion 52 is abruptly pivoted clockwise against the outer housing 50. This is heard and felt by the user.

From a comparison of FIGS. 1 and 2, it can be seen that, with the same total length of the torque wrench, the "function lever", i.e. the distance between the bearing pin 56 and the point of engagement of the lever 62 with the outer housing 50, is longer in the torque wrench of FIG. 2 than is the "function lever" in the prior art embodiment of FIG. 1. Accordingly, spring 72 can be biased, i.e. tensioned, less than spring 38 of FIG. 1 since the transmitted forces are smaller.

It can furthermore be seen that the bearing pin 56 is closer to the point of rotation of the screw or other work in the embodiment of FIG. 2 than in the embodiment of FIG. 1. This is achieved in that the tool 58 of FIG. 2 is directly inserted into the outer housing 50. Thus, the bearing pin 56 can be arranged in the outer housing closely adjacent to the tool. Nevertheless, the bearing pin 56 is sufficiently spaced from the end of the outer housing 50 to ensure that the support of such pin will be stable. The construction of FIG. 2 also permits the contact point of lever 62 of the toggle lever mechanism 82 with the outer housing 50, as well as the toggle lever mechanism itself, to be placed toward the right in FIG. 2. Thus, the force becomes smaller and the toggle lever mechanism can be made smaller. The lengthening of the "function lever" does not result in an increase of the mass, because the outer housing 50 is used for this purpose. The inner part can be relatively lightweight.

Figure 3:
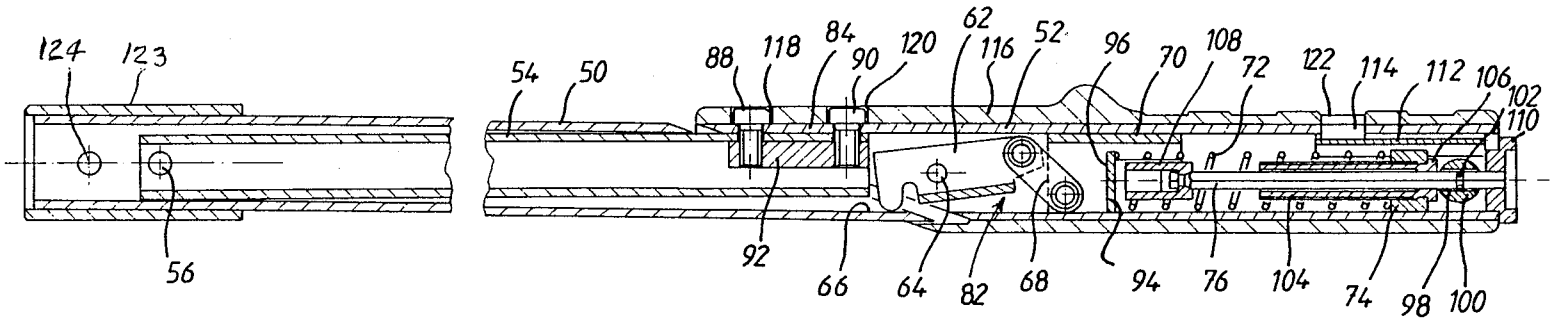
FIG. 3 is a longitudinal sectional view of a constructional embodiment of the torque wrench of FIG. 2.

FIG. 3 shows a preferred constructional embodiment of the torque wrench. Corresponding elements are designated by the same numerals in FIG. 3 as in FIG. 2.

As shown, the inner part comprises a tubular section 54 fixedly attached by two screws 88 and 90 to a tubular handle section 52. The screws 88 and 90 are screwed into a nut block 92 on the inside of section 54.

The slider 70 is advantageously formed of sheet metal bent to an inverted u-shape and movably guided in handle section 52 of the inner part. The two legs of slide 70 are cut longitudinally and transversely to form edges 94. A thrust disc 96 engages these edges 94. The spring 72 encircles the adjusting spindle 76 and extends between the thrust disc 96 and the nut 74. Thereby the thrust disc 96 is always held in engagement with the edges 94.

Adjusting spindle 76 is hexagonal in cross-section and extends through a hexagonal passage in an externally threaded bushing 104 and through an end piece 106 located at the right end of bushing 104. Thus, spindle 76 is non-rotatable relative to bushing 104 and end piece 106. End piece 106 engages a transverse pin 100 and, in turn, is engaged oppositely by a nut 74 in the illustrated extreme right position thereof. Adjusting spindle 76 is slidable longitudinally in a hexagonal passage 98 through transverse pin 100, which is affixed at its ends to handle member 52 of the inner part. A circumferential groove 102 in spindle 76 is engaged by a spring-loaded detent ball located in pin 100. Thus, adjusting spindle 76, in the illustrated axial position, is held snapped in. However, adjusting spindle 76 can be axially pulled out to the right, thereby overcoming the detent spring loading of the detent ball.

The axial position of nut 74 and the related bias of spring 72 are selectively adjusted by rotating adjusting spindle 76 and, conjointly therewith, the bushing 104 about their common axis in one direction or the other, using the button 110 on the right end of adjusting spindle 76 that extends out of handle member 52 of the inner part.

A stop body 108 is attached to the left end of adjusting spindle 76 and limits movement of the adjusting spindle to the right in FIG. 3 in that stop body 108 comes into engagement with the front end of threaded bushing 104.

A scale support 112 having a scale marked along its left end portion is connected to nut 74, being displaced therewith to the left or the right as button 110 is turned in one direction or the other. The scale can be read through an aperture 114 in handle member 52 and an aperture 122 in a handle 116 that advantageously encircles, for example, handle member 52 of the inner part as a close-fitting sleeve.

In the construction illustrated, handle 116 is secured to the handle member by the screws 88 and 90 passing through the apertures 118 and 120, respectively, with their heads inset into such apertures.

No work-engaging tool is shown in FIG. 3, but a tool, corresponding, for example, to the tool 58 in FIG. 2, may be inserted in the tool-receiving-and-holding end **50*a* of outer housing 50, which, as here shown, is provided with a reinforcing sleeve 123. A locking pin (not shown) for securing the tool in place is inserted through a bore 124**.

Whereas this invention is here illustrated and described with specific reference to embodiments thereof presently contemplated as the best modes of carrying out such invention in actual practice, it is to be understood that various changes may be made in adapting the invention to different embodiments without departing from the broader inventive concepts disclosed herein and comprehended by the claims that follow.

I claim:

1. A torque wrench, comprising an elongate outer housing; an elongate inner part extending rigidly within said housing from adjacent one end thereof to and beyond the opposite end thereof, that portion of said inner part extending beyond the said opposite end of the housing constituting a handle portion for the wrench, there being clearance between said inner part and said housing permitting transverse movement of one relative to the other; means adjacent to the said one end of the housing pivotally interconnecting said inner part and said housing; means for holding a work-engaging tool at and connected to the said one end of the housing; and spring-loaded, toggle lever mechanism operatively interconnecting said handle portion of the inner part and said outer housing for holding said inner part and said housing against transverse relative movement but arranged to release when a torque exerted on said tool by the wrench is excessive, thereby effecting sudden relative transverse movement between said inner part and said housing to alert the user of the wrench to the excessive torque.

2. A torque wrench as set forth in claim 1, wherein a work-engaging tool is held in the holding means free of the inner part.

3. A torque wrench as set forth in claim 1, wherein the outer housing is formed by a tube rectangular in cross section.

4. A torque wrench as set forth in claim 1, wherein the tool is adapted to be detachably inserted into the outer housing at the one end thereof.

5. A torque wrench as set forth in claim 1, wherein the inner part is tubular in two sections that are fixedly interconnected end to end.

6. A torque wrench as set forth in claim 5, wherein the opposite end of the outer housing terminates obliquely so that one wall thereof extends beyond an opposite wall thereof; and wherein the toggle lever mechanism includes a lever mounted in the handle portion and normally engaging the extended wall of the oblique end of the outer housing.

7. A torque wrench as set forth in claim 1, wherein the toggle lever mechanism comprises a lever mounted pivotally in the handle portion, which lever engages with the opposite end of the outer housing that is opposite the one end that is adapted to hold the tool; a link pivoted at the other end of the lever to form an angle with the longitudinally extending torque wrench; and a spring longitudinally biasing said link.

8. A torque wrench as set forth in claim 7, wherein the handle portion is hollow and the toggle lever mechanism is mounted therewithin.

9. A torque wrench as set forth in claim 7, including a slider slidably carried by the handle portion of the inner part, the link having its end that is remote from the lever pivotally connected to the slider, and the slider being biased by the spring.

10. A torque wrench as set forth in claim 9, wherein the slider is of inverted u-shape having its two legs cut longitudinally and transversely to form parallel edges perpendicular to the longitudinal extension of the wrench; a thrust disc engaging said edges, the biasing spring engaging and acting against said disc.

11. A torque wrench as set forth in claim 7, wherein a nut movable longitudinally but non-rotatably supports the spring in the handle member; a threaded bushing extends axially in and positionally fixed relative to the handle portion and threadedly engaged with said nut; an adjusting spindle extending axially within the threaded bushing and axially movable but non-rotatable relative thereto and rotatable conjointly therewith; and an adjusting knob carried by the adjusting spindle at an end thereof projecting from the handle portion for conjointly rotating said spindle and said bushing and moving said nut longitudinally to adjust the bias of the spring.

12. A torque wrench as set forth in claim 11, wherein means are provided in the handle portion for the adjusting spindle to snap into and to be held in a position to which it is moved by a user of the wrench.

13. A torque wrench as set forth in claim 12, wherein the snap means comprises a pin in the handle portion extending transversely thereof, the adjusting spindle passing through and being guided by a bore provided through said pin; and detent means within said bore acting on said adjusting spindle.

14. A torque wrench as set forth in claim 13, wherein the detent means comprises a circumferential groove in the adjusting spindle; and a spring-loaded detent ball is positioned in the transverse pin so as to engage the circumferential groove when the adjusting spindle is in a retracted position.

15. A torque wrench as set forth in claim 11, wherein a stop body is attached to the inner end of the adjusting spindle for limiting outward movement of said adjusting spindle by coming into contact with the threaded bushing.

16. A torque wrench according to claim 11, wherein the adjusting spindle is hexagonal in cross-section; and wherein the threaded bushing has an end piece provided with a hexagonal aperture therethrough.

17. A torque wrench as set forth in claim 11, wherein a scale carrier is attached to the nut and carries a scale; and wherein there is an aperture in the handle portion through which the scale can be read.

18. A torque wrench as set forth in claim 5, wherein an end of the one section of the inner part fits into an end of the other section of the inner part, the two sections being attached together by screws; wherein there is a nut block into which the screws are threaded; and wherein there is a handle with screw-receiving apertures arranged on the handle portion of the inner part, the heads of the screws being inset into said apertures.

19. A torque wrench as set forth in claim 1, wherein the spring-loaded, toggle lever mechanism is manually operable as tension-setting means for the wrench; and wherein a scale is carried by said tension-setting means for reading by the user of the wrench when setting the mechanism at a predetermined tension.

20. A torque wrench as set forth in claim 19, wherein the handle portion of the inner part is hollow, the tension-setting means is located within said handle portion, and said handle portion is apertured at the scale so the user can read the scale.

* * * * *